US010349157B2

(12) United States Patent
Karkkainen et al.

(10) Patent No.: US 10,349,157 B2
(45) Date of Patent: Jul. 9, 2019

(54) ACOUSTIC TRANSDUCER APPARATUS

(75) Inventors: Asta Karkkainen, Helsinki (FI); Juha Backman, Espoo (FI); Petri Soronen, Oulu (FI); Leo Kärkkäinen, Helsinki (FI)

(73) Assignee: Nokia Technologies Oy, Espoo (FI)

( * ) Notice: Subject to any disclaimer, the term of this patent is extended or adjusted under 35 U.S.C. 154(b) by 467 days.

(21) Appl. No.: 14/119,187

(22) PCT Filed: May 31, 2012

(86) PCT No.: PCT/FI2012/050536
§ 371 (c)(1),
(2), (4) Date: May 7, 2014

(87) PCT Pub. No.: WO2012/164168
PCT Pub. Date: Dec. 6, 2012

(65) Prior Publication Data

US 2014/0341420 A1 Nov. 20, 2014

(30) Foreign Application Priority Data

May 31, 2011 (GB) ..... 1109103.0

(51) Int. Cl.
*H04R 1/02* (2006.01)
*H04R 1/28* (2006.01)
(Continued)

(52) U.S. Cl.
CPC ..... *H04R 1/02* (2013.01); *H04R 1/2842* (2013.01); *H04R 1/345* (2013.01); *H04R 1/403* (2013.01);
(Continued)

(58) Field of Classification Search
CPC ..... H04R 1/2842; H04R 1/02; H04R 1/345; H04R 1/403; H04R 1/406; H04R 17/00; H04R 2201/401; H04R 2499/11
(Continued)

(56) References Cited

U.S. PATENT DOCUMENTS 4,233,477 A 11/1980 Rice et al.
4,864,619 A * 9/1989 Spates ..... H04R 5/0335 381/309
(Continued)

FOREIGN PATENT DOCUMENTS

CN 1473288 A 2/2004
EP 0181506 A2 5/1986
(Continued)

OTHER PUBLICATIONS

Extended European Search Report received for corresponding European Patent Application No. 12792481.9, dated Oct. 24, 2014, 7 pages.
(Continued)

*Primary Examiner* — Sean H Nguyen
(74) *Attorney, Agent, or Firm* — Harrington & Smith

(57) ABSTRACT

An apparatus comprising a flexible substrate material (901) configured to operate in at least two shapes and at least one transducer (801) located within the flexible substrate material (901) configured to produce a transducer output, wherein the flexible substrate (901) is configured to affect the transducer output.

19 Claims, 4 Drawing Sheets

(51) Int. Cl.
*H04R 1/34* (2006.01)
*H04R 17/00* (2006.01)
*H04R 1/40* (2006.01)

(52) U.S. Cl.
CPC ..... *H04R 1/406* (2013.01); *H04R 17/00* (2013.01); *H04R 2201/401* (2013.01); *H04R 2499/11* (2013.01)

(58) Field of Classification Search
USPC ..... 381/387, 25, 187
See application file for complete search history.

(56) References Cited

U.S. PATENT DOCUMENTS 5,146,501 A 9/1992 Spector
5,303,426 A 4/1994 Jones
5,673,329 A 9/1997 Wiener
5,706,253 A 1/1998 Nedderman, Jr.
6,438,249 B1 8/2002 Wiener
6,453,155 B1 * 9/2002 Hill ..... H04M 1/0279 379/430
2002/0126867 A1 * 9/2002 Aizik ..... H04R 7/00 381/399
2004/0146172 A1 * 7/2004 Goswami ..... H04R 5/033 381/378
2006/0104451 A1 5/2006 Browning et al.
2007/0025575 A1 * 2/2007 Oser ..... A47C 7/72 381/333
2008/0000714 A1 1/2008 Adams
2008/0132299 A1 * 6/2008 Bostaph ..... G06F 1/1615 455/575.1
2008/0146890 A1 * 6/2008 LeBoeuf ..... A61B 5/0059 600/300
2010/0008528 A1 1/2010 Isvan
2010/0034411 A1 * 2/2010 Mellow ..... H04R 1/225 381/345
2010/0208932 A1 * 8/2010 Liou ..... H04R 1/403 381/387
2010/0298895 A1 * 11/2010 Ghaffari ..... A61B 1/00082 607/3
2010/0327956 A1 12/2010 Karkkainen et al.
2011/0129109 A1 * 6/2011 Okutsu ..... H04R 1/025 381/332

FOREIGN PATENT DOCUMENTS

EP 1312423 A1 5/2003
EP 1 403 212 A2 3/2004
GB 1408626 A 10/1975
GB 2222054 2/1990
GB 2385231 A 8/2003
GB 2473265 A 3/2011
JP 2007142909 6/2007
JP 2007194708 6/2007
WO 1998/053638 A2 11/1998
WO WO-01/62040 A2 8/2001
WO 2005029911 3/2005
WO 2007004147 1/2007
WO 2009086555 7/2009
WO WO2011001012 1/2011

OTHER PUBLICATIONS

Search Report received for corresponding United Kingdom Patent Application No. 1109103.0, dated Aug. 15, 2012, 5 pages.
International Search Report received for corresponding Patent Cooperation Treaty Application No. PCT/FI2012/050536, dated Nov. 30, 2012 , 10 pages.

* cited by examiner

ACOUSTIC TRANSDUCER APPARATUS

RELATED APPLICATION

This application was originally filed as PCT Application No. PCT/FI2012/050536 filed May 31, 2012 which claims priority benefit from United Kingdom Patent Application No. 1109103.0, filed May 31, 2011.

FIELD OF THE APPLICATION

The present application relates to a method and apparatus. In some embodiments the method and apparatus relate to speaker apparatus.

BACKGROUND OF THE APPLICATION

Some portable devices comprise integrated speakers for creating sound such as playing back music or having a telephone conversation. The loudness of the integrated speakers is important especially in environments where the ambient noise levels are high, even indoors. The loudness of the integrated speakers in a portable device is important for perception of ringtones of a mobile telephone. In some countries the loudness of the integrated speakers is important for listening to radio broadcasts.

In some parts of the world a portable device with an integrated speaker may be the only device the user owns which is capable of playing music. For example, a user may only be able to play music using a loudspeaker of a mobile telephone. The loudness and quality of sound from an integrated speaker is even more important if a user is solely reliant on an integrated speaker of a portable device for music playback.

Furthermore nanotechnology is a toolbox of methods that enable the tailoring or construction of structures at molecular scales and permit the tuning of properties of the materials forming the structures. These advanced materials enable bendable and even stretchable devices to be constructed. The possibility to bend, twist and stretch the device with the ability to measure the affect of the bending, twisting and stretching the device enables the bending, twisting or stretching to be used as an input method to control the device.

According to a first aspect there is provided an apparatus comprising: a flexible substrate material configured to operate in at least two shapes; and at least one transducer located within the flexible substrate material configured to produce a transducer output, wherein the flexible substrate is configured to affect the transducer output.

The flexible substrate may be configured with at least one adjustable cavity which can open and close a surface opening coupling the transducer to the outside of the apparatus.

The flexible substrate may be configured with two adjustable cavities, a first cavity opening a surface opening coupling the transducer to the outside of the apparatus and a second cavity forming an adjustable acoustic filter for the transducer.

The apparatus may further comprise an adhesive material on the surface of the flexible substrate material so to enable a seal when closing the adjustable cavity.

The apparatus may further comprise a layer of harder flexible material on the surface of the flexible substrate material.

The flexible substrate material may be configured with the at least one adjustable cavity to form a small opening suitable for an earpiece opening.

The flexible substrate material may be configured with the at least one adjustable cavity to form a large opening suitable for a handsfree opening.

The at least one transducer may be a dipole transducer, and wherein the at least one adjustable cavity may comprise a first adjustable cavity which can open and close a surface opening coupling the transducer to one side of the apparatus and a second adjustable cavity which can open and close a second surface opening coupling the transducer to the opposite side of the apparatus.

The flexible substrate material may couple at least two transducers in such a way that flexing the substrate material locates the transducers within a defined array configuration.

The flexible substrate material may be configured to be able to perform at least one of: stretched so to increase the distance between the at least two transducers; compressed so to decrease the distance between the at least two transducers; bent inwards so to shorten the audio focal point between the at least two transducers; and bent outwards so to lengthen the audio focal point between the at least two transducers.

The flexible substrate material may form a flexible mesh locating the at least one transducer relative to other transducers.

The flexible substrate material may be configured to propagate acoustic waves between the outside of the apparatus and the transducer.

The transducer output may be at least one audio signal affected based on the shape of the flexible material.

The apparatus may further comprise: at least one sensor configured to generate a configuration output; and a signal processor configured to signal process the transducer output dependent on the configuration output.

The at least one sensor may comprise at least two sensors of different types.

The at least one transducer may comprise an array of transducers which are flexibly coupled by the flexible substrate material.

The flexible substrate material may be a web of flexible polymer which surrounds the transducers.

The flexible substrate material may comprise at least one of: a carbon nanotube network; a graphene ribbon network; a flexible polymer; a cavity or void filled with foam; a polymer material; a foam material; and a polymer with microscale cracks configured to make the substrate flexible.

According to a second aspect there is provided an apparatus comprising: flexible substrate means configured to operate in at least two shapes; and transducer means located within the flexible substrate means configured to produce a transducer means output, wherein the flexible substrate means affect the transducer means output.

The flexible substrate means may comprise at least one adjustable cavity which can open and close a surface opening coupling the transducer means to the outside of the apparatus.

The flexible substrate means may be configured with two adjustable cavities, a first cavity opening a surface opening coupling the transducer means to the outside of the apparatus and a second cavity forming an adjustable acoustic filter for the transducer means.

The apparatus may further comprise adhesive means on the surface of the flexible substrate means so to enable a seal when closing the adjustable cavity.

The apparatus may further comprise a further more rigid means on the surface of the flexible means.

The flexible substrate means may be configured with the at least one adjustable cavity to form a small opening suitable for an earpiece opening.

The flexible substrate means may be configured with the at least one adjustable cavity to form a large opening suitable for a handsfree opening.

The transducer means may be a dipole transducer, and wherein the at least one adjustable cavity may comprise a first adjustable cavity which can open and close a surface opening coupling the transducer means to one side of the apparatus and a second adjustable cavity which can open and close a second surface opening coupling the transducer means to the opposite side of the apparatus.

The flexible substrate means may couple at least two transducer means in such a way that flexing the substrate material locates the transducer means within a defined array configuration.

The flexible substrate means may be configured to be able to perform at least one of: stretched so to increase the distance between the at least two transducer means; compressed so to decrease the distance between the at least two transducer means; bent inwards so to shorten the audio focal point between the at least two transducer means; and bent outwards so to lengthen the audio focal point between the at least two transducer means.

The flexible substrate means may form a flexible mesh locating the at least one transducer means relative to other transducer means.

The flexible substrate means may be configured to propagate acoustic waves between the outside of the apparatus and the transducer means.

The transducer means output may be at least one audio signal affected based on the shape of the flexible substrate means.

The apparatus may further comprise: at least one sensor means for generating a configuration output; and signal processor means for signal processing the transducer output dependent on the configuration output.

The at least one sensor means comprises at least two sensors of different types.

The at least one transducer means may comprise an array of transducers which are flexibly coupled by the flexible substrate material.

The flexible substrate means may be a web of flexible polymer which surrounds the transducers.

The flexible substrate means may comprise at least one of: a carbon nanotube network; a graphene ribbon network; a flexible polymer; a cavity or void filled with foam; a polymer material; a foam material; and a polymer with microscale cracks configured to make the substrate flexible.

The transducer or transducer means may be at least one of: a microphone transducer; and a speaker transducer.

BRIEF DESCRIPTION OF DRAWINGS

For a better understanding of the present application and as to how the same may be carried into effect, reference will now be made by way of example to the accompanying drawings in which.

DESCRIPTION OF SOME EMBODIMENTS OF THE APPLICATION

The following describes apparatus and methods for providing flexible or stretchable devices suitable for controlling audio inputs.

Before building the totally flexible or stretchable device that includes only flexible or stretchable components, it is possible to build a flexible or stretchable device that consists of a stretchable or flexible substrate and both rigid and flexible or stretchable components. In the case of rigid components, the rigid components should be as small as possible in order to keep the size of the device small. In addition to the flexible or stretchable substrate the connectors or couplings can in some embodiments also be flexible or stretchable.

It would be understood that in some embodiments the performance of connecting polymers would not be good enough for stretchable speaker connects. However in some embodiments carbon nano-tube networks of graphene ribbon networks could provide or form stretchable connects.

The performance of an electro-dynamic speaker in some embodiments depends on the geometry of cavities, or acoustic chambers coupled to the transducer. In some embodiments thus the flexible or stretchable device can be configured to be formed with an electro-dynamic speaker kept rigid.

Figure 1:
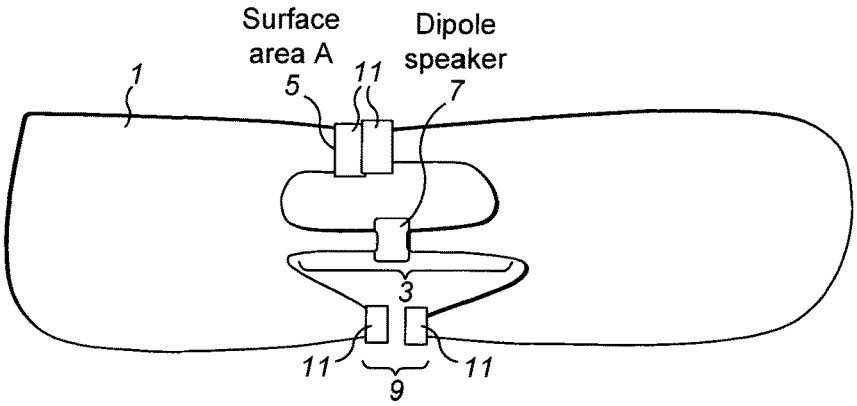
FIG. 1 illustrates a schematic representation of a flexibly controlled portable device according to some embodiments.

FIG. 1 discloses a schematic representation of a portable device suitable for coupling to apparatus according to some embodiments of the application.

The portable device 1 can be a mobile phone, portable audio device, user equipment or any other means for playing sound. The portable device is in some embodiments a mobile terminal, mobile phone or user equipment for operation in a wireless communication system. In other embodiments, the portable device is any suitable electronic device configured to generate sound, such as, for example, a digital camera, a portable audio player (also known as MP3 players), a portable video player (MP4 player).

The portable device in some embodiments comprises a dipole speaker 7. The dipole speaker can comprise any suitable acoustic transducer means. The acoustic transducer means can be in some embodiments a dynamic or moving coil configuration, a piezoelectric transducer, an electrostatic transducer or a transducer array comprising microelectromechanical systems (MEMS). Additionally or alternatively the transducer comprises a multifunction device (MFD) component having any of the following: combined earpiece, integrated handsfree speaker, vibration generation means, or a combination thereof.

The dipole speaker 7 can be configured in some embodiments to receive power from a printed circuit board or printed wire board. The printed wire board/printed circuit board can comprise many different components such as a processor, memory, transceiver, sound generating module. The printed wire board or printed circuit board can furthermore in some embodiments be connected or coupled to a display and furthermore in some embodiments coupled to an antenna.

In some embodiments the dipole speaker can be configured to be located within the portable device 1 in a fixed or rigid portion 3 of the portable device. However the portable device is configured with a flexible or stretchable portion or flexible substrate material or means which can open or close surface areas located between the dipole speaker 7 and the external portion of the device. For example FIG. 1 shows the portable device such that the portable device is arranged such that there is a 'smooth' and constant surface area A 5 which seals the dipole speaker 7 with respect to the surface area side and creates a small opening 9 with respect to the opposite side. This opening, for example, can in some embodiments be suitable for an earpiece opening.

Figure 2:
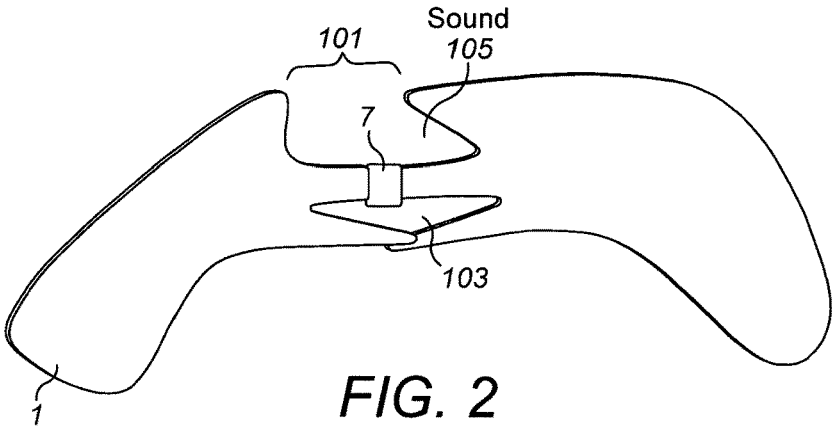
FIG. 2 illustrates a schematic representation of a flexibly controlled portable device in a second configuration according to some embodiments.

With respect to FIG. 2, the portable device is configured such that in some embodiments the flexible or stretchable portion opens a large opening 101 in the 'top' surface area. Furthermore in some embodiments the flexible or stretchable portion can further create at least one adjustable cavity. For example in some embodiments such as shown in FIG. 2 the flexible portion defines an acoustic cavity 105, 'a front cavity', between the opening 101 and the dipole speaker 7. Furthermore in some embodiments the portable device is configured such that the flexible or stretchable portion can seal the small opening 9 in the 'bottom' surface area. Furthermore in sealing the small opening 9, the portable device can create a second acoustic cavity 103, a 'rear cavity', between the sealed opening 9 and the dipole speaker 7. In such embodiments the cavities can tune the output of the dipole speaker in a suitable and desired manner, in other words operate as an acoustic filter. For example the cavities and the large opening 101 can be configured to be suitable for generating a hands free output.

Figure 3:
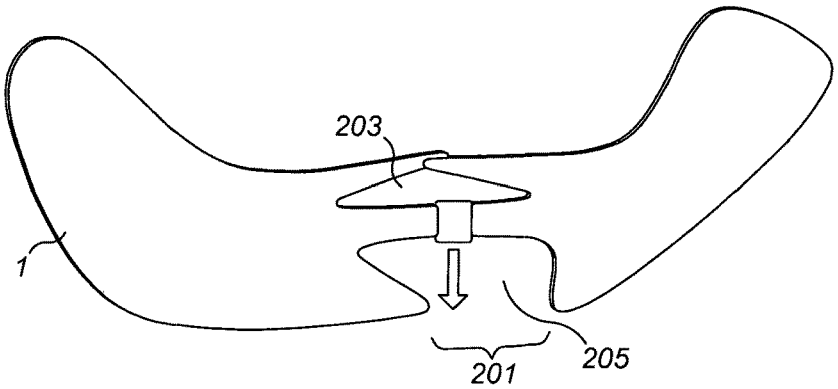
FIG. 3 illustrates a schematic representation of a flexibly controlled portable device in a further configuration according to some embodiments.

With respect to FIG. 3, the portable device is configured such that in some embodiments the flexible or stretchable portion opens a further large opening 201 in the 'bottom' surface area. Furthermore in some embodiments the flexible or stretchable portion can further create an acoustic cavity 205, 'a front cavity' with respect to the opening, between the opening 201 and the dipole speaker 7. Furthermore in some embodiments the portable device is configured such that the flexible or stretchable portion can seal the large opening 101 in the 'top' surface area. Furthermore in sealing the large opening 101 in the 'top' surface area, the portable device can create a second acoustic cavity 203, a 'rear cavity' with respect to the opening, between the sealed opening 101 and the dipole speaker 7. In such embodiments the cavities can tune the output of the dipole speaker in a suitable and desired manner. For example the cavities and the large opening 201 can be configured to be suitable for generating a hands free output directed in the opposite way to the output shown in FIG. 2.

In such a way the portable device can be configured to switch the direction and volume of the sound according to the orientation of the device. In other words by bending the portable device in a first direction a hole at the top surface can be opened or formed and the hole of the bottom closed or sealed enabling in such embodiments to permit sound to exit out from the top of the device. Furthermore by bending the portable device to the other direction the hole of the top closes and the hole of the bottom opens permitting sound to exit from the bottom of the portable device.

In some embodiments therefore the portable device or apparatus comprises a flexible device configured with a flexible substrate material, the flexible device further configured with tiny cavities on at least one of an upper part and lower part of the device, and a dipole speaker which can be configured to be located within the device between the cavities.

In some embodiments the flexible device can be configured with adhesive 11 material on the surface of the substrate so to enable an better seal when closing the cavities.

Furthermore in some embodiments the portable device is constructed with a thin layer of harder flexible material on the surface to make the device feel nice in the hand.

It would be understood that in some embodiments the speaker, for example as shown herein the dipole speaker, can be configured to operate within a flexible or stretchable device. Wherein typically speakers operate within fixed cavities, the geometries of which affect the sound pressure level, and thus the sound quality of the device, the bending and stretching the device as can have an effect on the audio output. In some embodiments therefore the portable device can be configured in such a manner that for the stretchable device the transducer, for example a piezoelectric transducer, can be configured to actuate or move the surface of the portable device which in turn is configured to actuate the air in contact with the surface of the device to generate the acoustic waves for outputting an audio signal. In such embodiments the actuator can be configured to be both bendable and rigid enough according to the situation.

Figure 4:
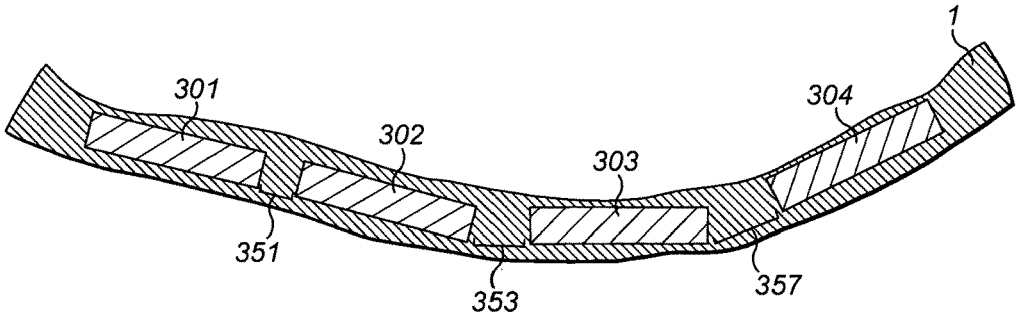
FIG. 4 discloses a schematic representation of a flexible speaker actuator arrangement in a first configuration according to some embodiments.
Figure 5:
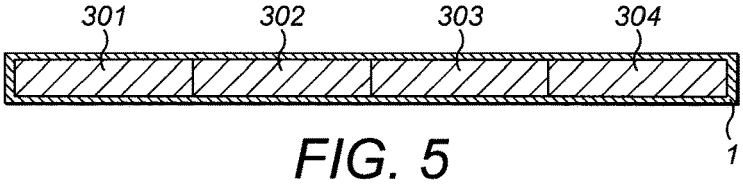
FIG. 5 discloses a schematic representation of a flexible speaker actuator arrangement in a further configuration according to some embodiments.

With respect to FIGS. 4 and 5 an example configuration of transducers according to some embodiments of the application can be shown. FIG. 4 shows a line or one dimensional array of transducers located within a flexible device in such a way that the transducers can be flexibly configured. In some embodiments the portable device 1 can be configured with the line of transducers, for example, a first flexible piezo-electric transducer bar 301, a second flexible piezo-electric transducer bar 302, a third flexible piezo-electric transducer bar 303, and a fourth flexible piezo-electric transducer bar 304. The piezo-electric transducer bars 301 can be located in some embodiments within a flexible material, for example a flexible polymer. Furthermore in some embodiments the flexible material can be configured to transmit the movement of the actuator to the surface of the device and thus generate the acoustic wave. In some embodiments the flexible material can be a cavity or void filled with air or foam.

With respect to FIG. 4 the transducer configuration is shown in a first arrangement wherein each piezo-electric transducer bars is separated from the next. For example in such embodiments the first flexible piezo-electric transducer bar 301 is separated from the second flexible piezo-electric transducer bar 302 by a first gap or displacement 351, the second flexible piezo-electric transducer bar 302 is separated from the third flexible piezo-electric transducer bar 303 by a second gap or displacement 353, and the third flexible piezo-electric transducer bar 301 is separated from the fourth flexible piezo-electric transducer bar 304 by a third gap or displacement 355.

With respect to FIG. 5 the transducer configuration is shown in a second arrangement wherein the transducers in such embodiments can be arranged to form one 'rigid' line—in other words the gaps are reduced such that each transducer is touching the adjacent transducer.

Although the examples shown herein show a one dimension configuration it would be understood that in some embodiments two dimension speaker transducer configurations could be constructed using further one dimensional arrays.

Furthermore it would be understood that although embedded transducers are shown that transducers which are partially exposed on the surface of the mobile device could be implemented in some embodiments.

Figure 6:
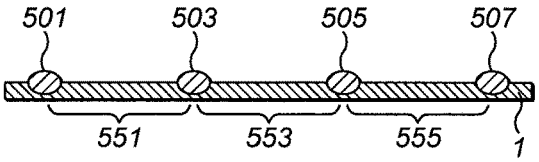
FIG. 6 discloses a schematic representation of a flexible microphone actuator arrangement in a first configuration according to some embodiments.
Figure 7:
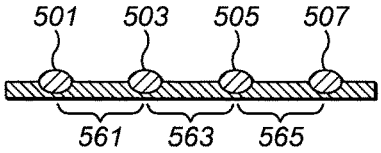
FIG. 7 discloses a schematic representation of a flexible microphone actuator arrangement in a further configuration according to some embodiments.
Figure 8:
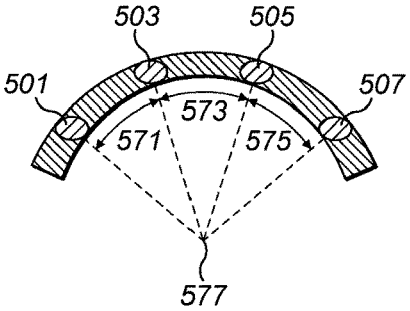
FIG. 8 discloses a schematic representation of a flexible microphone actuator arrangement in an arc configuration according to some embodiments.

Furthermore as shown with respect to FIGS. 6 to 8, a similar arrangement to those shown herein for acoustic wave generation apparatus is shown for acoustic wave capture devices or apparatus.

In some embodiments the portable device 1 can be configured with a line or one dimensional array of acoustic transducers, or microphones, configured to convert a received acoustic wave into a suitable electrical form. The acoustic transducers or microphones can in some embodiments be located within a stretchable or flexible substrate. For example the substrate can in some embodiments comprise a polymer or foam material. In some embodiments the portable device maintains some element of support for the acoustic transducers by means of a surface layer which is more rigid than the interior of the substrate or in some embodiments the substrate can overlie a flexible and/or stretchable skeleton. Furthermore in some embodiments the acoustic transducers are configured to be at least partially embedded within the substrate of the portable device.

For example with respect to FIG. 6 a first configuration of the portable device is shown wherein the portable device comprises a four transducer line or one dimensional array of transducers partially embedded within the flexible substrate. In such a way the first transducer 501, or microphone, can be separated by a first distance 551 to a second transducer 503. Similarly in some embodiments the second transducer 503, or microphone, can be separated by a second distance 553 to a third transducer 505. Furthermore the third transducer 505 can be separated by a third distance 555 to a fourth transducer 507. In the example shown herein the first to third distances are approximately the same, in other words a regular array of transducers are shown, however it would be understood that an irregular array can be produced by moving one transducer relative to another.

In such a manner any suitable or desired configuration of microphones can be constructed in such embodiments of the application. For example with respect to FIG. 7, a more closely packed array configuration is shown wherein the first transducer 501 is separated by a first shorter distance 561 to the second transducer 503, the second transducer 503 separated by a second shorter distance 563 to the third transducer 505 and the third transducer 505 separated by a shorter third distance 565 to the fourth transducer 507. This can be achieved by compressing or folding the flexible substrate to reduce the distance.

Furthermore it would be appreciated that in some embodiments by bending the substrate two or three dimensional transducer arrays can be formed. For example by simply bending the flexible substrate into an arc the transducers can be configured to form an arc array of transducers, defined by an arc centre 577 and first arc angle 571 describing a separation between the first and second transducers, second arc angle 573 describing a separation between the second and third transducers, and third arc angle 575 describing a separation between the third and fourth transducers.

In such a manner in some embodiments the portable device or apparatus can be further configured to model the beam former settings with modes according to the configuration of the microphones. In other words the processing of the signals can be determined based on the arrangement of the substrate. In other words in some embodiments the substrate is configured to provide the relevant information with respect to the distances between transducers and so enable signal processing of inputs or outputs dependent on the configuration of the transducers.

In some embodiments the transducer configuration or arrangement is sensed due to different acoustic field measured.

In some embodiments therefore apparatus can comprise a microphone array, a flexible and/or stretchable substrate at least partially within which is located the microphone array. The flexible and/or stretchable substrate can be configured to be any suitable polymer. The structure of the polymer can in some embodiment be designed such that the effect of the stretching or bending is more controlled than with a continuous substrate. In some embodiment the apparatus can further comprise a configuration sensor. Furthermore in some embodiments the apparatus can further comprise signal processing of the audio signal dependent for example on a sensor. Such a sensor can be an accelerometer, orientation sensor, and furthermore machine learning can in some embodiments can be implemented to recognize the orientation of the device and thus optimize the direction of the beam. In some embodiment the microphones or transducers can be coupled by stretchable and/or connects such as a graphene ribbon network.

It would be understood that in some embodiments that the transducers themselves be configured in a two or three dimensional array configuration.

It would be understood that the construction of a large rigid transducer configuration would not in some embodiments be suitable for implementation in flexible and/or stretchable substrate portable devices.

Figure 9:
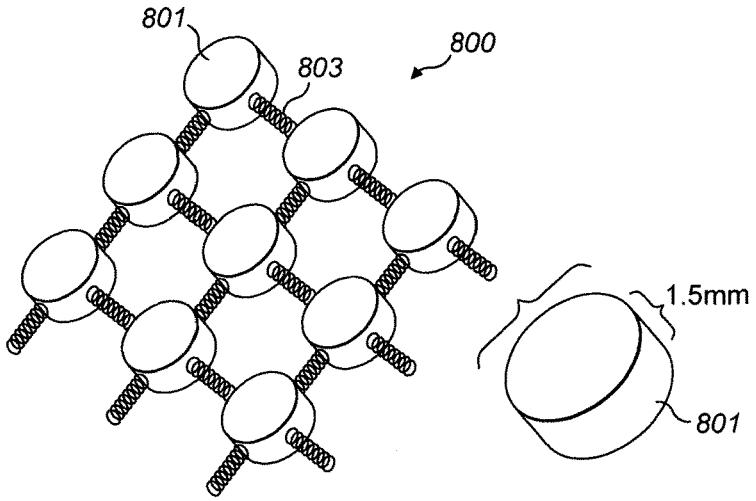
FIG. 9 discloses a schematic representation of a flexible actuator array arrangement according to some embodiments.

With respect to FIG. 9 an example configuration of a loudspeaker array configured to produce in some embodiments an improved performing transducer performance is shown. In such an example the speaker and/or microphone area 800 is constructed from an array, which in some embodiments can be a two dimensional array of transducers 801 which are flexible coupled to each other via a substrate link 803. As shown in FIG. 9 the transducers can be configured to be in some embodiments about 1.5 mm in diameter.

Figure 10:
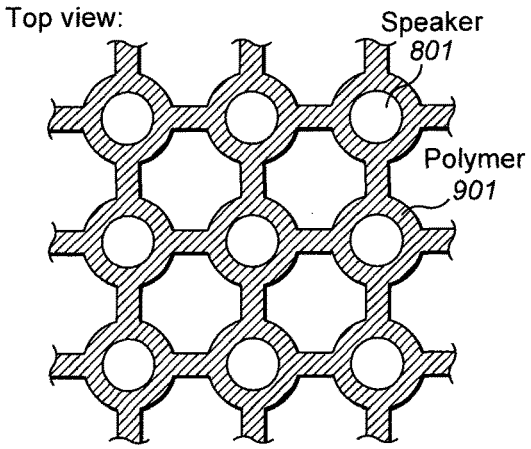
FIG. 10 discloses a schematic representation of a flexible actuator array arrangement in a first view according to some embodiments.

With respect to FIG. 10 an example top view of the array configuration is shown wherein each transducer 801 (speaker) is located within a web of flexible polymer 901 which surrounds the transducer and further is coupled to the neighbouring or adjacent polymer portions surrounding an associated transducer.

Figure 11:
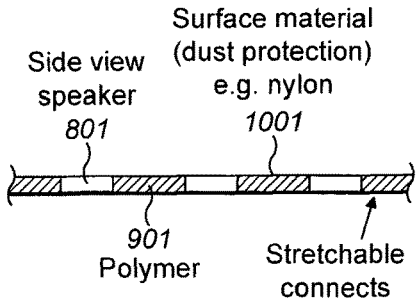
FIG. 11 discloses a schematic representation of a flexible actuator array arrangement in a second view according to some embodiments.

With respect to FIG. 11 an example side view is shown of the array configuration wherein the polymer 901 links or couples the transducer 801 in the web such that the polymer 901 forms stretchable connects between the transducers. In some embodiments the polymer and transducer layer can furthermore be covered in a top and bottom surface material layer 1001. The surface material layer 1001 can in some embodiments be a nylon layer and be used as dust or physical protection.

Figure 12:
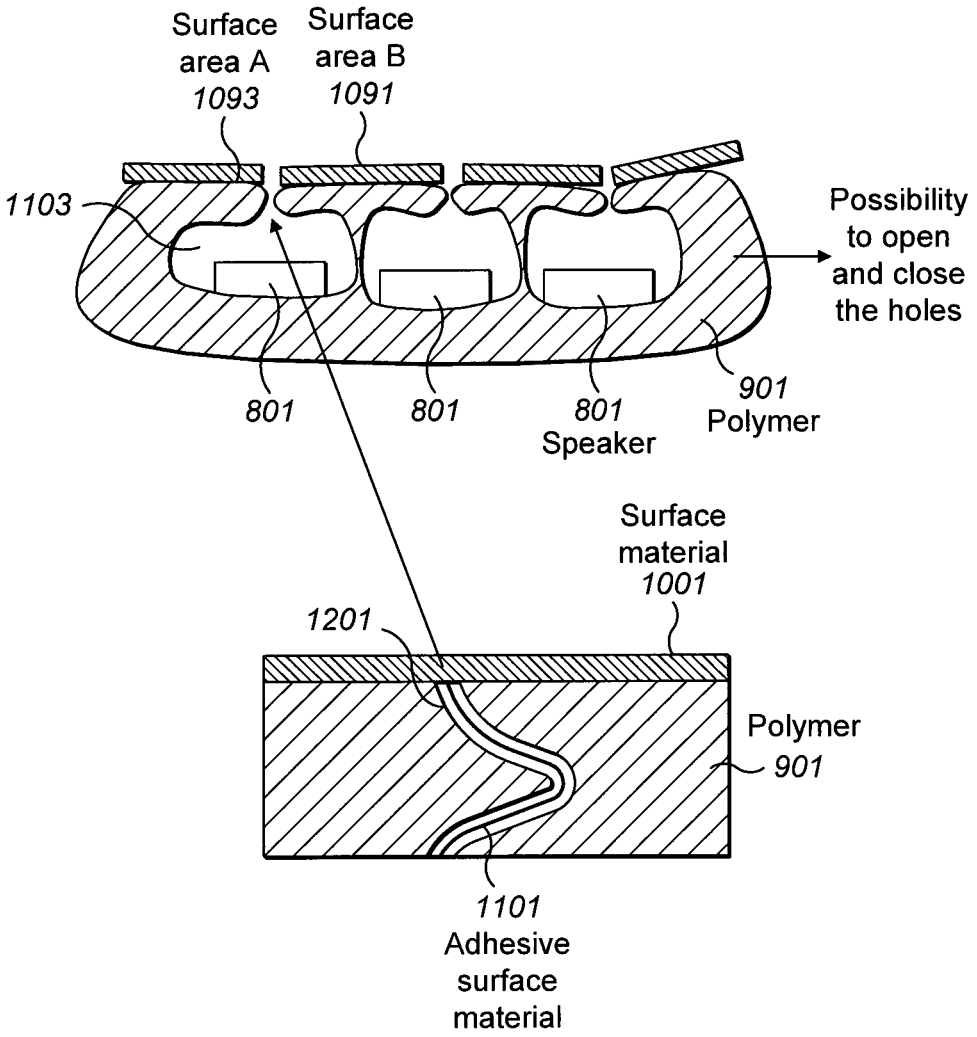
FIG. 12 discloses a further schematic representation of a flexible actuator array arrangement according to some embodiments.

In some embodiments, such as shown in FIG. 12 can form pockets 1103 within which the transducers 801 lie. In some such embodiments a hole region within the polymer 901 can be formed as there is a small gap in the polymer layer within which the transducer lies which couples the pocket or cavity to the surface later. For example as shown in FIG. 12 the surface layer A 1093 and surface layer B 1091 of the surface layer 1001 are separated by a small gap 1201 which can be opened and sealed by opening and closing the throat region of the polymer 901. As described herein in some embodiments the throat region of the polymer 901 suitable for forming the hole/gap can be coated in an adhesive surface material 1101 suitable for assisting the formation of a seal when the throat region is closed.

Thus in some embodiments there can comprise an apparatus comprising a loudspeaker array of small, rigid electrodynamic loudspeakers. In some embodiments the array comprises at least 8 loudspeakers. The transducers as shown herein can be separated or coupled by a stretchable substrate. The substrate can in some embodiments be a polymer or thin layer of any material with microscale cracks that make the layer stretchable. In some embodiments there can overlie the transducer a thin, flexible or stretchable surface layer configured to be suitable for protecting the transducers from dust, for example a nylon net.

It shall be appreciated that the term portable device can in some embodiment be user equipment. The user equipment is intended to cover any suitable type of wireless user equipment, such as mobile telephones, portable data processing devices or portable web browsers. Furthermore, it will be understood that the term acoustic sound channels is intended to cover sound outlets, channels and cavities, and that such sound channels may be formed integrally with the transducer, or as part of the mechanical integration of the transducer with the device.

In general, the various embodiments may be implemented in hardware or special purpose circuits, software, logic or any combination thereof. Some aspects of the invention may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware.

For example, in some embodiments the method of manufacturing the apparatus may be implemented with processor executing a computer program.

Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising:

at least one processor;

at least one memory including computer program code;

a flexible substrate configured to operate in a first configuration and a second configuration;

at least one acoustic transducer located within the flexible substrate, wherein the flexible substrate is configured to affect at least one output signal of the at least one acoustic transducer based on the first and second configurations; and at least one sensor configured to determine one of the first configuration or the second configuration;

wherein the flexible substrate is configured with at least one adjustable cavity to substantially open and close a surface opening which acoustically couples the at least one acoustic transducer to the outside of the apparatus;

the at least one memory and the computer program code configured to, with the at least one processor, cause the apparatus to enable signal processing of input or output signals for the at least one acoustic transducer based on the first configuration and the second configuration.

2. The apparatus as claimed in claim 1, wherein the flexible substrate is configured with a second adjustable cavity forming an adjustable acoustic filter for an input or output from the at least one acoustic transducer.

3. The apparatus as claimed in claim 2, wherein the output from the at least one acoustic transducer is formed as at least one dipole acoustic transducer output wherein the at least one acoustic transducer is acoustically coupled to opposite sides of the apparatus.

4. The apparatus as claimed in claim 3, wherein the at least one adjustable cavity opens and closes the surface opening coupling the at least one acoustic transducer to one side of the apparatus and the second adjustable cavity opens and closes a second surface opening coupling the at least one acoustic transducer to the opposite side of the apparatus.

5. The apparatus as claimed in claim 1, further comprising a layer of harder flexible material on the outer surface of the apparatus.

6. The apparatus as claimed in claim 1 wherein the flexible substrate is configured to form an opening and wherein the at least one acoustic transducer is an earpiece speaker.

7. The apparatus as claimed in claim 1, wherein the flexible substrate is configured to form an opening and wherein the at least one acoustic transducer is a handsfree speaker.

8. The apparatus as claimed in claim 1, wherein the flexible substrate is configured to form an opening and wherein the at least one acoustic transducer is a microphone transducer.

9. The apparatus as claimed in claim 1, wherein the at least one acoustic transducer comprises at least two acoustic transducers and the flexible substrate couples the at least two acoustic transducers so as to locate the at least two acoustic transducers within an array configuration.

10. The apparatus as claimed in claim 9, wherein the flexible substrate is configured to be at least one of:

stretched so as to increase the distance between the at least two acoustic transducers;

compressed so to decrease the distance between the at least two acoustic transducers;

bent inwards so as to shorten the audio focal point between the at least two acoustic transducers; or bent outwards so as to lengthen the audio focal point between the at least two acoustic transducers.

11. The apparatus as claimed in claim 9, wherein the flexible substrate forms a flexible mesh for flexibly coupling and locating the at least two acoustic transducers relative to each other.

12. The apparatus as claimed in claim 1, wherein the flexible substrate is configured to propagate acoustic waves between the outside of the apparatus and the at least one acoustic transducer.

13. The apparatus as claimed in claim 1, wherein the at least one sensor is configured to generate a sensor output; and wherein the at least one memory and the computer program code configured to, with the at least one processor, further cause the apparatus to process the at least one acoustic transducer output dependent on the sensor output.

14. The apparatus as claimed in claim 13, wherein the at least one sensor is at least one of:

an accelerometer; or an orientation sensor.

15. The apparatus as claimed in claim 13, wherein the at least one sensor comprises at least two sensors of different types.

16. The apparatus as claimed in claim 1, wherein the flexible substrate substantially surrounds the at least one acoustic transducer.

17. The apparatus as claimed in claim 1, wherein the flexible substrate comprises at least one of:

a carbon nanotube network;

a graphene ribbon network;

a flexible polymer;

a cavity or void filled with foam;

a polymer material;

a foam material; or a polymer with microscale cracks configured to make the substrate flexible.

18. The apparatus as claimed in claim 1, wherein the apparatus in the first configuration operates in a first shape and the apparatus in the second configuration operates in a second shape.

19. The apparatus as claimed in claim 1, wherein at least a portion of the at least one acoustic transducer is at an internal portion of the apparatus and wherein the adjustable cavity is between the at least one acoustic transducer and an external portion of the apparatus.

* * * * *